US010113253B2

(12) United States Patent
Hottes et al.

(10) Patent No.: US 10,113,253 B2
(45) Date of Patent: Oct. 30, 2018

(54) METHOD AND APPARATUS FOR FABRICATING SUSCEPTOR COIL ASSEMBLIES

(71) Applicant: The Boeing Company, Chicago, IL (US)

(72) Inventors: Christopher John Hottes, Seattle, WA (US); Jeffrey M. Hansen, Renton, WA (US)

(73) Assignee: The Boeing Company, Chicago, IL (US)

( * ) Notice: Subject to any disclaimer, the term of this patent is extended or adjusted under 35 U.S.C. 154(b) by 511 days.

(21) Appl. No.: 14/870,434

(22) Filed: Sep. 30, 2015

(65) Prior Publication Data

US 2017/0092421 A1 Mar. 30, 2017

(51) Int. Cl.

| | |
|---|---|
| ***D02G 3/38*** | (2006.01) |
| ***H01F 41/064*** | (2016.01) |
| ***B65H 54/28*** | (2006.01) |
| ***B65H 59/02*** | (2006.01) |
| ***B65H 75/10*** | (2006.01) |

(52) U.S. Cl.

CPC ..... *D02G 3/38* (2013.01); *B65H 54/28* (2013.01); *B65H 59/02* (2013.01); *B65H 75/10* (2013.01); *H01F 41/064* (2016.01); *B65H 2701/36* (2013.01)

(58) Field of Classification Search

CPC ..... D02G 3/38

See application file for complete search history.

(56) References Cited

U.S. PATENT DOCUMENTS

| | | | | |
|---|---|---|---|---|
| 4,463,547 | A * | 8/1984 | Young | H01B 13/08 505/917 |
| 4,470,248 | A * | 9/1984 | Nortenius | H01B 13/26 57/17 |
| 5,330,608 | A * | 7/1994 | Kemmler | H01B 13/01281 156/351 |
| 5,517,812 | A * | 5/1996 | Simmons | H01B 13/26 242/420.5 |
| 7,520,120 | B2 * | 4/2009 | Saito | H01B 13/0866 57/10 |
| 7,698,883 | B2 * | 4/2010 | Dye | A61N 1/05 57/10 |

(Continued)

OTHER PUBLICATIONS

U.S. Appl. No. 14/870,531, filed Sep. 30, 2015.

(Continued)

*Primary Examiner* — Shaun R Hurley

(74) *Attorney, Agent, or Firm* — McDonnell Boehnen Hulbert & Berghoff LLP

(57) ABSTRACT

A method and system for fabricating a susceptor coil assembly. An apparatus comprising a tensioning section; a feeding section for feeding a conductor wire toward the tensioning section, the tensioning section maintaining a desired tension of the conductor wire; and a coiling section for winding a susceptor wire around an outer surface of the conductor wire so as to fabricate a susceptor coil assembly. The coiling section winds the susceptor wire around the conductor wire as the conductor wire moves from the feeding section towards the tensioning section. A first programmable drive is programmable to achieve a desired feedrate of the conductor wire from the feeding section to the coiling section.

20 Claims, 16 Drawing Sheets

(56) References Cited

U.S. PATENT DOCUMENTS

| | | | | |
|---|---|---|---|---|
| 8,236,223 | B2 * | 8/2012 | Graves | A61F 2/958 264/293 |
| 8,330,086 | B2 | 12/2012 | Miller et al. | |
| 9,719,194 | B2 * | 8/2017 | Chi-Hsueh | D02G 3/12 |
| 2005/0028512 | A1 * | 2/2005 | Boni | D02G 3/12 57/212 |
| 2008/0083209 | A1 * | 4/2008 | Saito | H01B 13/0866 57/3 |
| 2012/0145702 | A1 | 6/2012 | Miller et al. | |
| 2015/0218734 | A1 * | 8/2015 | Chi-Hsueh | D02G 3/12 57/222 |
| 2017/0094729 | A1 * | 3/2017 | Hottes | B29C 66/80 |

OTHER PUBLICATIONS

U.S. Appl. No. 14/640,227, filed Mar. 16, 2015.
U.S. Appl. No. 14/640,217, filed Mar. 6, 2015.
U.S. Appl. No. 14/640,234, filed Mar. 6, 2015.

* cited by examiner

METHOD AND APPARATUS FOR FABRICATING SUSCEPTOR COIL ASSEMBLIES

FIELD

The present disclosure relates generally to susceptors for use with heating blankets. More particularly, the present disclosure relates to methods and apparatus for fabricating a susceptor coil assembly comprising a smart susceptor wire wrapped around an outer surface of a conductor wire.

BACKGROUND

A composite part may be bonded or cured in an oven or an autoclave where heat is applied to the part while supported on a cure tool that maintains the shape of the part during the curing process. Techniques have been developed for curing composite parts without the need for an oven or autoclave. However, these techniques have been limited to curing relatively small, simple parts and/or require relatively complicated and/or expensive tooling. Recently, curing of relatively small composite parts has been achieved using induction heating equipment employing ferromagnetic susceptors that produce a maximum, constant temperature when inductively heated. For example, heating blankets using inductively heated susceptors have been used to cure relatively small areas of a composite rework patch applied to a structure such as an aircraft skin.

In certain known heating blankets, the blankets are constructed by threading springs of susceptor wire onto a length of a conductor wire that is designed for carrying high frequency current, commonly referred to in the art as a Litz wire. When threading the susceptor wire onto the conductor wire, it is generally desired to orient the susceptor wire as near to perpendicular as possible to the direction of current flow in the Litz wire. A near perpendicular orientation is desired so as to maximize the induced magnetic fields into the susceptor wire which creates heat by virtue of eddy currents created by the wire. By using springs (i.e., preformed or wrapped onto the Litz wire), the susceptor can be oriented along the Litz wire in order to capitalize on a high density of susceptor per unit length of the Litz wire and keep the susceptor wire in the region of highest magnetic field strength (i.e., as close to orthogonal to the direction of current flow within the Litz wire).

This threaded spring configuration has been shown to produce suitable results for certain heating blanket applications, but also has demonstrated certain limitations. For example, in such spring configurations, a large amount of Litz wire is typically required to carry the appropriate amount of current for large heating blankets. In addition, a large amount of Litz wire is typically also required to maintain an applied voltage within certain safety levels, and also to produce the required amount of heat. Therefore, the spring threaded configurations do not lend themselves to providing a practical heating blanket for large heating or curing applications. Moreover, is has been proven difficult to keep the susceptor springs from tangling with one another within the heating blanket. In addition, susceptor springs were not cost effective for large sized heating blankets.

Accordingly, there is a need for cost effective methods and devices that can be utilized to fabricate susceptor based heating blankets while customizing such blankets so as to achieve desired heating profiles, especially for heating large composite structures.

SUMMARY

According to an exemplary embodiment, an apparatus 10 for fabricating a susceptor coil assembly 450 is disclosed. The apparatus 10 comprises a tensioning section 500; a feeding section 100 for feeding a conductor wire 145 toward the tensioning section 500, the tensioning section 500 maintaining a desired tension of the conductor wire; and a coiling section 300 for winding a susceptor wire 325 around an outer surface 150 of the conductor wire 145 so as to fabricate a susceptor coil assembly 450. The coiling section 300 winds the susceptor wire 325 around the conductor wire 145 as the conductor wire 145 moves from the feeding section 100 towards the tensioning section 500.

In one exemplary arrangement, the apparatus 10 further comprises a first programmable drive system 170 that is programmable to achieve a desired feed rate of the conductor wire 145 from the feeding section 100 to the coiling section 300. In one exemplary arrangement, the first programmable drive system 170 operates a plurality of traction reels 200, and a first smart motor 220 operating the plurality of reels 200, such that the conductor wire 145 is drawn over the plurality of traction reels 200 from a conductor wire supply 140 and into the coiling section 300.

In one exemplary arrangement, the apparatus 10 further comprises a second programmable drive system 380. This second programmable drive system 380 is programmable to achieve a desired feed rate of the susceptor wire 325 from a susceptor wire supply 320 and into the coiling section 300.

In one exemplary arrangement, apparatus 10 further comprises a third programmable drive system 570 that is programmable to achieve a desired tension in the conductor wire 145 as the conductor wire is fed from the feeding section 100 towards the tensioning section 500.

In one exemplary arrangement, the apparatus 10 further comprises a level wind assembly 520. In one preferred arrangement, the level wind assembly 520 receives the susceptor coil assembly 450 from the winding section 300 and actively guides the susceptor coil assembly 450 into the tensioning section 500. In one exemplary arrangement, the level wind assembly 520 guides the susceptor coil assembly 450 into the tensioning section 500 by guiding the susceptor coil assembly 450 in a predetermined manner onto a core 544 of a take up spool 540 of the tensioning section 500.

In one exemplary arrangement, the coiling section 300 of the apparatus comprises a winding head 340. In one arrangement, the winding head 340 comprises a first wire inlet for receiving the conductor wire 145 that is fed from the feed section 100, and a second wire inlet 344 for receiving the susceptor wire 325 that is fed radially into the winding head 340. The winding head 340 is configured to wind the susceptor wire 325 along an outer surface 150 of the conductor wire 145 so as to fabricate the susceptor coil assembly 450.

In one exemplary arrangement, the apparatus 10 further comprises a user interface for programming operating parameters of at least one of the first programmable drive system 170, the second programmable drive system 380 or the third programmable drive system 570. In one exemplary arrangement, the user interface is programmable for programming at least one of the first programmable drive system 170, the second programmable drive system 380, or the third programmable drive system 570 so as to achieve a desired characteristic of the susceptor coil assembly 450. In one exemplary arrangement, the desired characteristic of the susceptor coil assembly 450 comprises a susceptor coil assembly wrap density, wherein the susceptor coil assembly wrap density comprises a predetermined number of susceptor wire wraps for each linear unit of measurement of the conductor wire 145. In one exemplary arrangement, the susceptor coil assembly wrap density comprises about 25-30 wraps of susceptor wire 325 per inch of the wire conductor 145. As those of ordinary skill will recognize, the apparatus 10 may be configured to achieve alternative susceptor coil assembly wrap densities in order to obtain desired heating requirements or heating profiles. For example, the apparatus 10 may be configured to achieve varying susceptor coil assembly wrap densities along the same or different conductor wire in order to obtain desired heating requirements or heating profiles of a heating blanket.

In one exemplary arrangement, a method for fabricating a susceptor coil assembly 450 is disclosed. For example, the method may comprise the steps of feeding a conductor wire 145 from a feeding section 100 towards a tensioning section 500; and winding a susceptor wire 325 around an outer surface of the conductor wire 145 as the conductor wire 145 moves from the feeding section 100 towards a tensioning section 500 so as to fabricate a susceptor coil assembly 450. The tensioning section 500 is utilized to maintain a desired tension in the conductor wire 145 as the conductor wire 145 moves from the feeding section 100 to the tensioning section 500 of the apparatus 10.

In one exemplary arrangement, the method further comprises the step of utilizing a first programmable drive system 170 to draw the conductor wire 145 over a plurality of reels 200 from a conductor wire supply 140 and into the coiling section 300.

In one exemplary arrangement, the method further comprises the step of utilizing a second programmable drive system 380 to achieve a desired feedrate of the susceptor wire 325 from a susceptor wire supply 320 and fed into the coiling section 300.

In one exemplary arrangement, the method further comprises the step of maintaining a desired tension in the conductor wire 145 as the conductor wire 145 is fed from the feeding section 100 towards the tensioning section 500.

In one exemplary arrangement, the method further comprises the step of receiving the susceptor coil assembly 450 by a level wind assembly 520 from the coiling section 300. For example, the method may include the step of actively guiding the susceptor coil assembly 450 from the level wind assembly 520 onto a core 544 of a take up spool 540 in the tensioning section 500.

In one exemplary arrangement, the method further comprises the step of winding the susceptor wire 145 along an outer surface 150 of the conductor wire 145 so as to fabricate the susceptor coil assembly 450.

In one exemplary arrangement, the method further comprises the step of utilizing at least one programmable drive system 170, 380, 580 to achieve or to vary a desired characteristic of the susceptor coil assembly 450. Such a desired characteristic could be a pitch or a density of the susceptor wire density along the outer surface 150 of the conductor wire 145 (i.e., a distance between two adjacent susceptor wires of the susceptor coil assembly wound along the outer surface 150).

These as well as other advantages of various aspects of the present patent application will become apparent to those of ordinary skill in the art by reading the following detailed description, with appropriate reference to the accompanying drawings.

BRIEF DESCRIPTION OF THE DRAWINGS

The novel features believed characteristic of the illustrative embodiments are set forth in the appended claims. The illustrative embodiments, however, as well as a preferred mode of use, further structures and descriptions thereof, will best be understood by reference to the following detailed description of an illustrative embodiment of the present disclosure when read in conjunction with the accompanying drawings, wherein:

DETAILED DESCRIPTION

Figure 1:
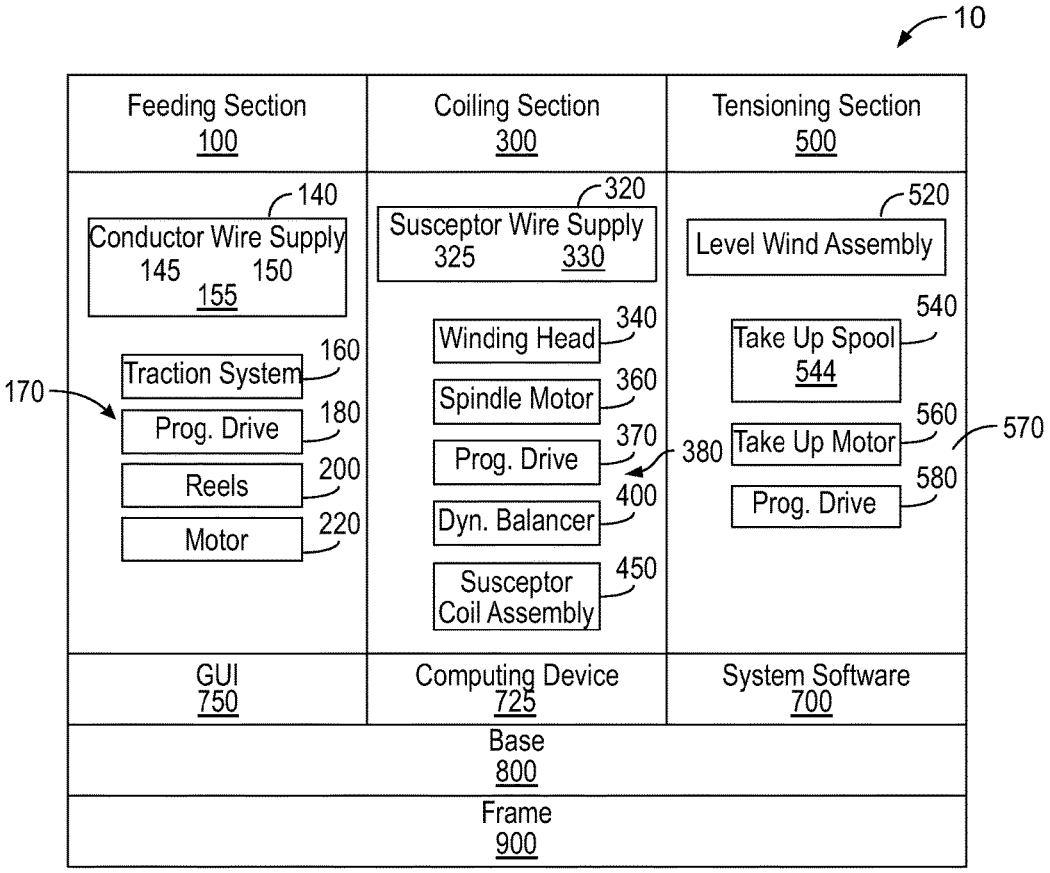
FIG. 1 is an diagrammatic representation of a functional block diagram of a apparatus for fabricating a susceptor coil assembly according to disclosed embodiments.

FIG. 1 is a diagrammatic representation of a functional block diagram of an apparatus 10 for fabricating a susceptor coil assembly 450 according to disclosed embodiments. As will be described in greater detail herein, the disclosed apparatus 10 may be used to fabricate a susceptor coil assembly 450: e.g., a ferromagnetic or smart susceptor 325 that is wound or coiled along an outer surface 150 of a conductor wire 145. Preferably, the wound coils may be provided at varying degrees to a longitudinal axis 155 of the conductor wire 145, e.g., a Litz wire. (See, FIG. 2A) In one preferred arrangement, the wound coils reside nearly orthogonal or perpendicular to a longitudinal axis 155 of the conductor wire 145.

Figure 2A:
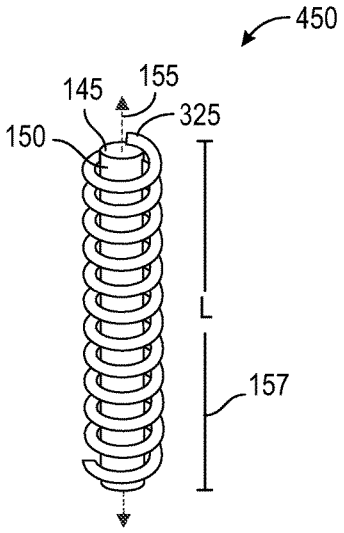
FIG. 2A is a diagrammatic representation of a susceptor coil assembly that may be fabricated by an apparatus, such as the apparatus represented by the functional block diagram of FIG. 1.

For example, the apparatus 10 may be used for fabricating a susceptor coil assembly 450, such as the exemplary susceptor coil assembly 450 illustrated in FIG. 2A. The apparatus 10 provides an efficient and cost effective method of fabricating customizable susceptor coil assemblies 450 for use in a wide variety of heating blankets for heating an assortment of different composite or other structures, particularly large composite structures. In this illustrated susceptor coil assembly 450, the assembly comprises a spring or coil shaped susceptor 325 that is wound around an outer surface 150 of a conductor wire 145. As noted herein, the wound coils reside nearly orthogonal or perpendicular to a longitudinal axis 155 of the conductor wire 145.

In one preferred arrangement, the conductor wire 145 comprises a Litz wire. As will be discussed in greater detail herein, the apparatus 10 of FIG. 1 can be used to fabricate a susceptor coil assembly 450 wherein the number of turns of the susceptor wire 325 can be varied along a length of the conductor wire 145. As just one example, the susceptor coil assembly 450 illustrated in FIG. 2A comprises a total number of 12 turns of the susceptor wire 325 that is provided along a length L 157 of the conductor wire 145. One advantage of the apparatus illustrated in FIG. 1 is that the system software 700 can be programmed to operate the apparatus so as to provide a susceptor coil assembly 450 having a specified total number of susceptor wire turns per unit of length L 157 of the conductor wire 145. By being able to program the susceptor density along the conductor wire, various different types of heating profiles generated by the susceptor coil assemblies can be achieved efficiently and cost effectively.

Returning to FIG. 1, as illustrated, the apparatus 10 for fabricating a susceptor coil assembly 450 comprises essentially three processing sections: a feeding section 100, a coiling or winding section 300, and a tensioning section 500. The feeding section 100 feeds a conductor wire 145 from a conductor wire supply 140 toward the tensioning section 500 at a predetermined rate. Preferably, the tensioning section 500 maintains a desired tension of the conductor wire 145 as the conductor wire 145 is fed from the feed section 100, into the coiling section 300 and then into the tensioning section 500. The coiling section 300 draws the susceptor wire 325 from the susceptor wire supply 320 and then winds the susceptor wire 325 around an outer surface 150 of the conductor wire 145 so as to fabricate a susceptor coil assembly, such as the susceptor coil assembly 450 illustrated in FIG. 2A. The coiling section 300 winds the susceptor wire 325 around the conductor wire 145 as the conductor wire 145 moves from the feeding section 100 towards the tensioning section 500. The coiling section 300 can be programmed so as to achieve a desired number of susceptor wire turns per unit of length L 157 of the conductor wire 145.

A first programmable drive system 170 is programmable to operate a traction system motor 220 to achieve a desired feed rate of the conductor wire 145 from the feeding section 100 to the coiling section 300. Preferably, the traction system motor 220 comprises a smart motor such as an induction motor comprising an integral encoder that provides shaft position feedback to the system software 700. In one preferred arrangement, the first programmable drive system 170 further comprises a plurality of traction reels 200 wherein the traction system motor 220 controls the operation the plurality of reels 200, such that the conductor wire 145 is drawn over the plurality of reels 200 from the conductor wire supply 140 and into the coiling section 300. The various programmable drive systems 170, 380, 570 of the apparatus 10 may all be operated and controlled by way of a computing device 725 running the system software 700.

The feeding section 100, the winding section 300, and the tensioning section 300 may all be operated by way of the computing device 725 wherein the system software 700 may be accessible by way of a graphical user interface 750 (or GUI). As just one example, the system software 700 may comprise a G-code logic system software provided by Moog Animatics. As will be explained in greater detail herein, the apparatus 10 comprises a plurality of programmable drive systems (e.g., smart motors) that may be operated in unison so as to fabricate a susceptor coil assembly 450 comprising at least one susceptor coil assembly characteristic (e.g., susceptor wire winds per linear inch of conductor wire).

In one preferred arrangement, the various sections 100, 300, 500 of the apparatus 10 are supported along a top surface 810 of a base 800 portion for support the various components. In one preferred arrangement, the base 800 of the apparatus 10 is further supported by an apparatus frame 900.

In this illustrated embodiment of apparatus 10, the feeding section 100 comprises a conductor wire supply 140 for supplying a conductor wire 145 to the winding or coiling section 300 of the apparatus 10. A motorized traction system 160 of the feeding section 100 is controlled by the programmable drive system 170 so as to feed the conductor wire 145 at a predetermined rate from the conductor wire supply 140 into the coiling section 300. Preferably, the feeding section 100 feeds the conductor wire 145 into the coiling section 300 at a predetermined rate or feed rate. As will be described in greater detail herein, the motorized traction system 160 of the feeding section 100 utilizes the first programmable drive system 170 to control a traction system motor 220 that turns a plurality of traction reels 200 in a controlled manner. Preferably, the first programmable drive 180 of the first programmable drive system 170 is operated and controlled by the system software 700 and whose operating settings may be accessible by way of the graphical user interface 750.

The apparatus 10 further includes the coiling or winding section 300 which resides downstream of the feeding section 100. In this preferred arrangement, the coiling section 300 comprises a susceptor wire supply 320, a winding head 340, a dynamic balancer 400, and a second programmable drive system 380. In one preferred arrangement, the susceptor wire supply 320 comprises susceptor wire 325 provided on a susceptor wire spool 330 that is freely rotatable.

The second programmable drive system 380 comprises a programmable drive 370 and a spindle motor 360. Preferably, this spindle motor 360 comprises a smart motor as described herein. The coiling section 300 produces the susceptor coil assembly 450. Preferably, the second programmable drive system 380 is operated and controlled by the system software 700 and whose operating settings may be accessible by way of the graphical user interface 750. In a preferred arrangement, the two smart motors (i.e., the spindle motor 360 of the coiling section 300 and the traction system motor 220 of the feeding section 100) are coordinated through the system software 700 such that these two smart motors are able to turn at any ratio relative to one another.

The tensioning section 500 is positioned downstream of the winding section 300 and receives the fabricated susceptor coil assembly 450 from the winding section 300. The tensioning system 500 comprises a level wind assembly 520, a take up spool 540, and a third programmable drive system 570 comprising a take up motor 560 and programmable drive 580. By way of a third programmable drive system 570, the tensioning section 500 is programmed by way of the graphical user interface 750 to maintain a desired amount of tension in the conductor wire 145 as this wire is fed from the feeding section 100 and into the winding section 300.

The level wind assembly 520 of the tensioning section 500 acts to guide the susceptor coil assembly 450 into the tension section 500. In one preferred arrangement, the level wind assembly 520 actively guides the fabricated susceptor coil assembly 450 onto a core 544 of a take up spool 540 within the tensioning section 500.

Figure 3:
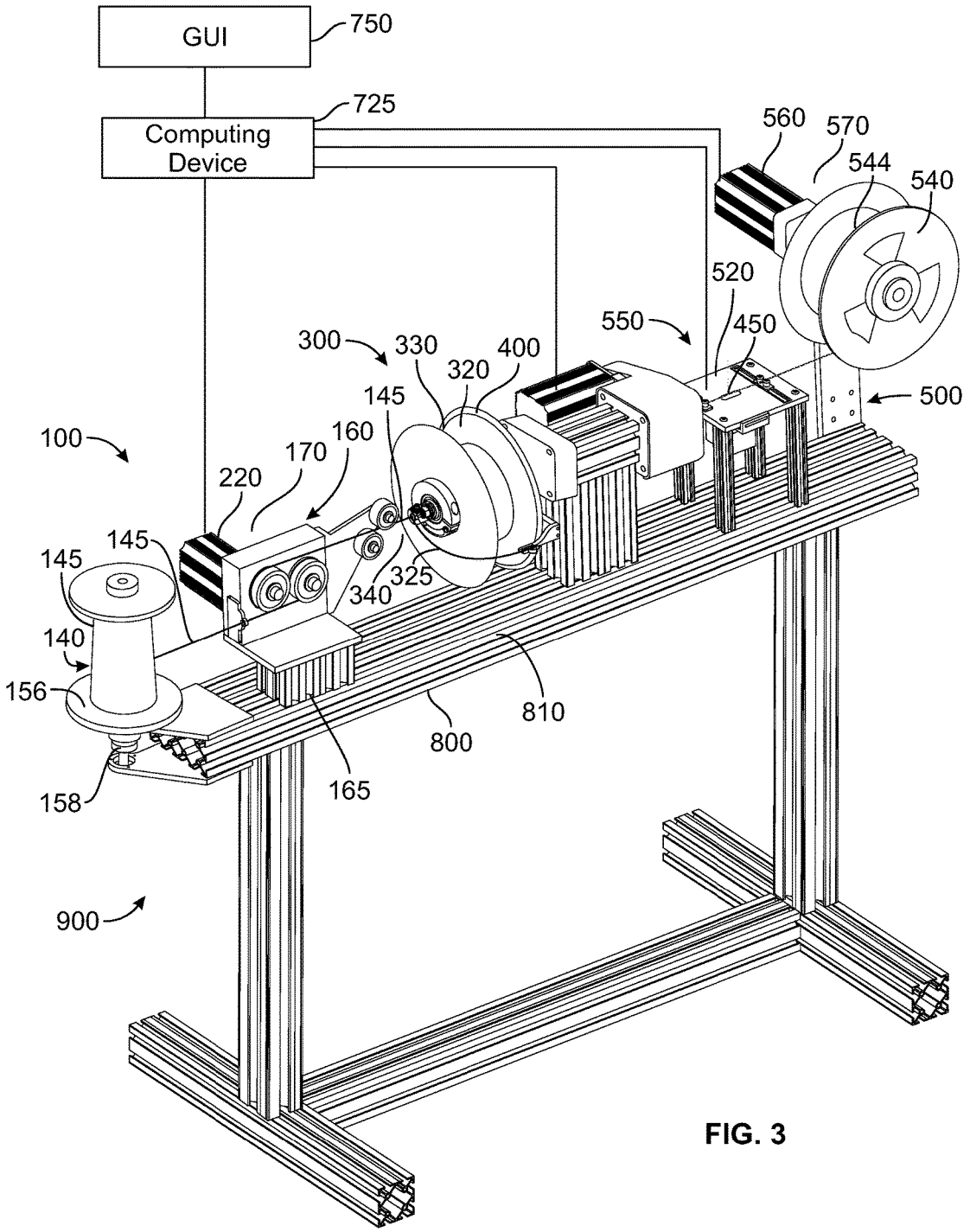
FIG. 3 is a diagrammatic representation of an apparatus for fabricating a susceptor coil assembly according to disclosed embodiments.
Figure 4:
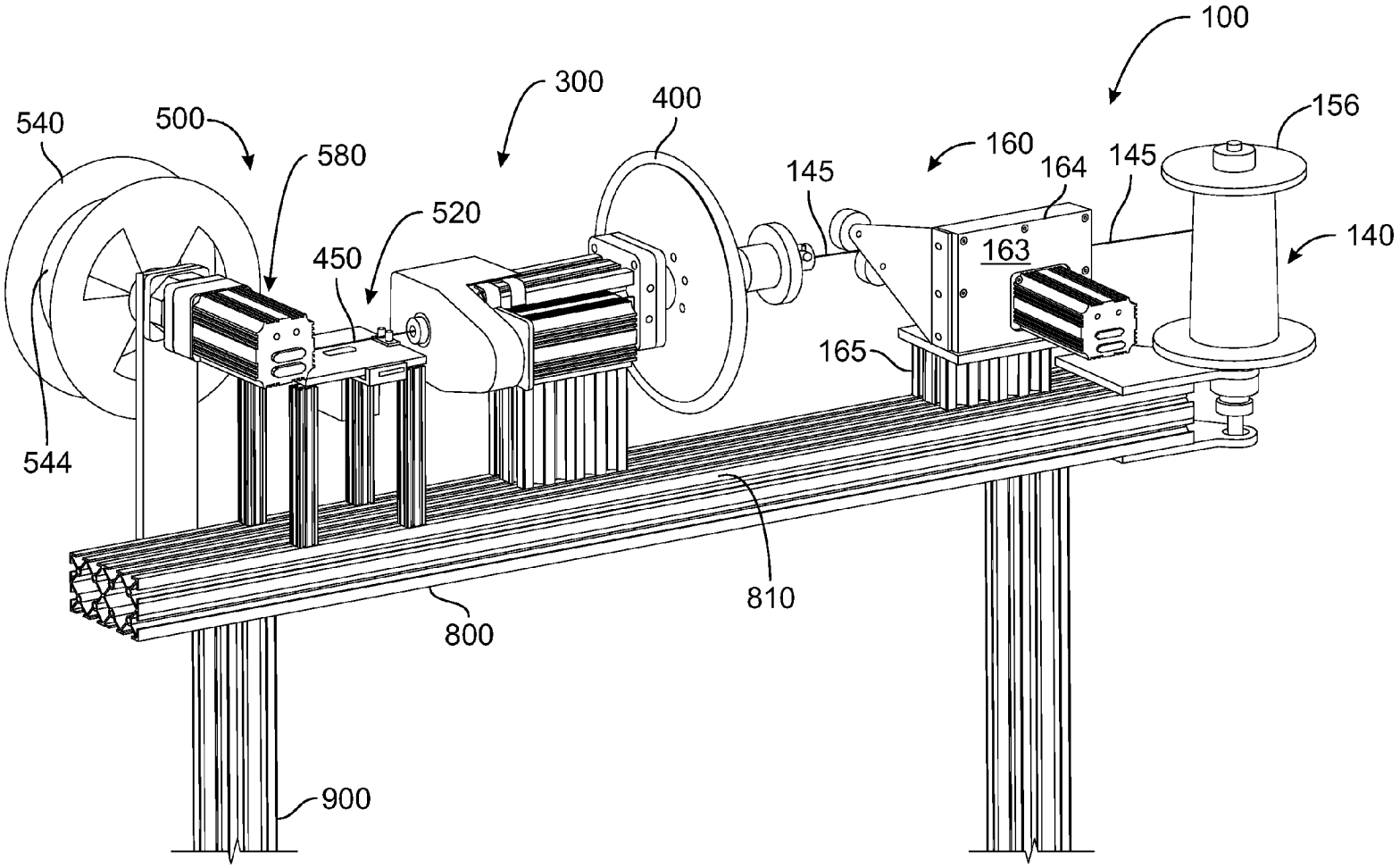
FIG. 4 is another diagrammatic representation of the apparatus of FIG. 3.

FIG. 3 is a diagrammatical representation of an apparatus 10 for fabricating a susceptor coil assembly 450, such as the coil assembly 450 illustrated in FIG. 2A. FIG. 4 is another diagrammatical representation of the apparatus 10 illustrated in FIG. 3. Referring now to FIGS. 3 and 4, the apparatus 10 comprises a feeding section 100, a coiling section 300, and a tensioning section 500. The feeding section 100, the winding section 300, and the tensioning section 500 may all be operated by way of the computing device 725 wherein the system software 700 may be accessible by way of a graphical user interface 750. Specifically, the first programmable drive system 170 of the feeding section 100, the second programmable drive system 380 of the winding section 300, and the third programmable drive system 570 of the tensioning section 300 may all be operated by way of the computing device 725 wherein the system software 700 may be accessible by way of a graphical user interface 750.

The apparatus further comprises a base 800 that is supported by a frame 900. In this illustrated arrangement, the various system components comprising the feeding, coiling, and tensioning sections 100, 300, 500 are all supported along a top surface 810 of the base 800.

The feeding section 100 includes a conductor wire supply 140 preferably in the form of a conductor wire spool 156. In one preferred arrangement, the conductor wire supply 140 is freely rotatable about a vertically oriented spindle 158. In one preferred arrangement, the conductor wire supply 140 comprises a conductor wire supply of Litz wire. The conductor wire supply 140 provides the conductor wire 145 into the motorized traction system 160. As illustrated, the motorized traction system 160 is mounted on a fraction pedestal 165 which is securely affixed to a top surface 810 of the apparatus base portion 800.

Figure 5:
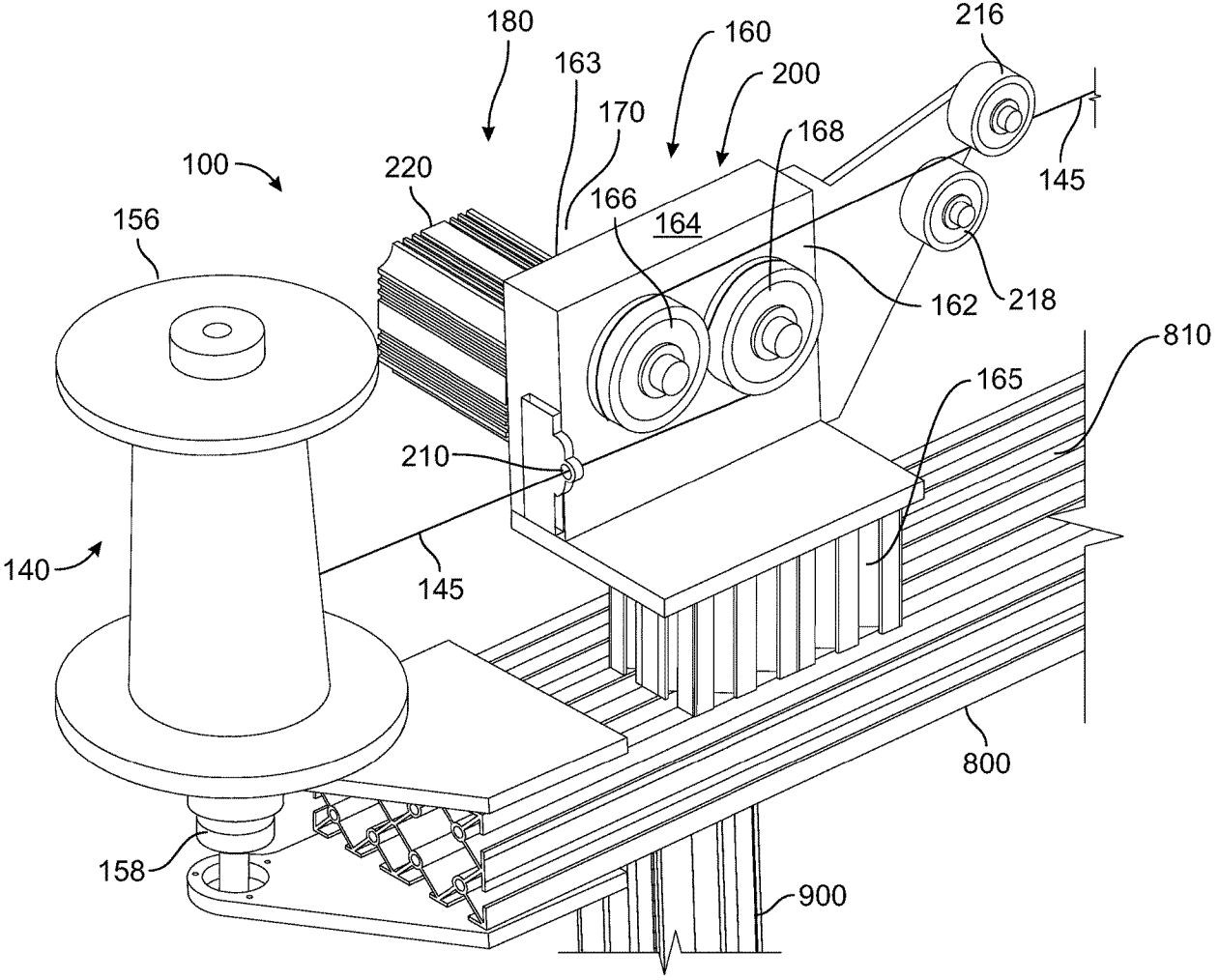
FIG. 5 is a diagrammatic representation of a feeding section of the apparatus of FIGS. 3 and 4.
Figure 6:
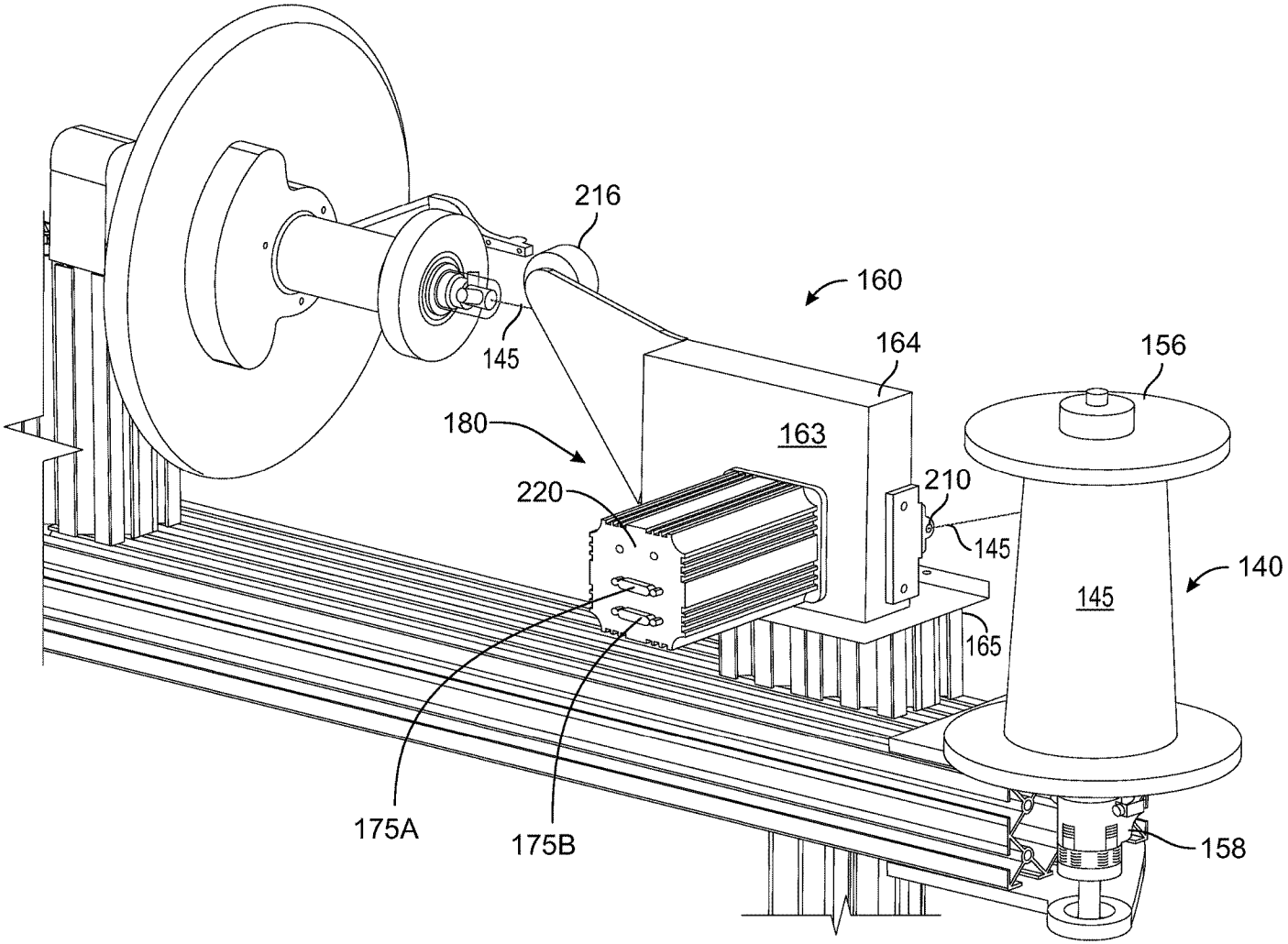
FIG. 6 is another diagrammatic representation of the feeding section of the apparatus of FIGS. 3 and 4.

FIG. 5 is diagrammatic illustration of the motorized traction system 160. FIG. 6 is another diagrammatic illustration of the traction system 160. As illustrated in FIGS. 5 and 6, the traction system 160 comprises a plurality of traction reels 200 that are mounted onto a first surface 162 of a traction main wall portion 164 of the traction system 160. The first and second traction reels 166, 168 are operated by way of a first programmable drive system 170. As can be seen from FIG. 6, the first programmable drive system 170 comprises a programmable drive 180 that is mounted on a second surface 163 of the traction main wall portion 164 (See, e.g., FIGS. 4 and 6). The programmable drive 180 comprises two data ports 175A,B for communication with the computing device 725 (See e.g., FIG. 6). The programmable drive 180 operates the traction system motor 220 so as to turn the reels 200 at a predetermined, desired speed.

Figure 7:
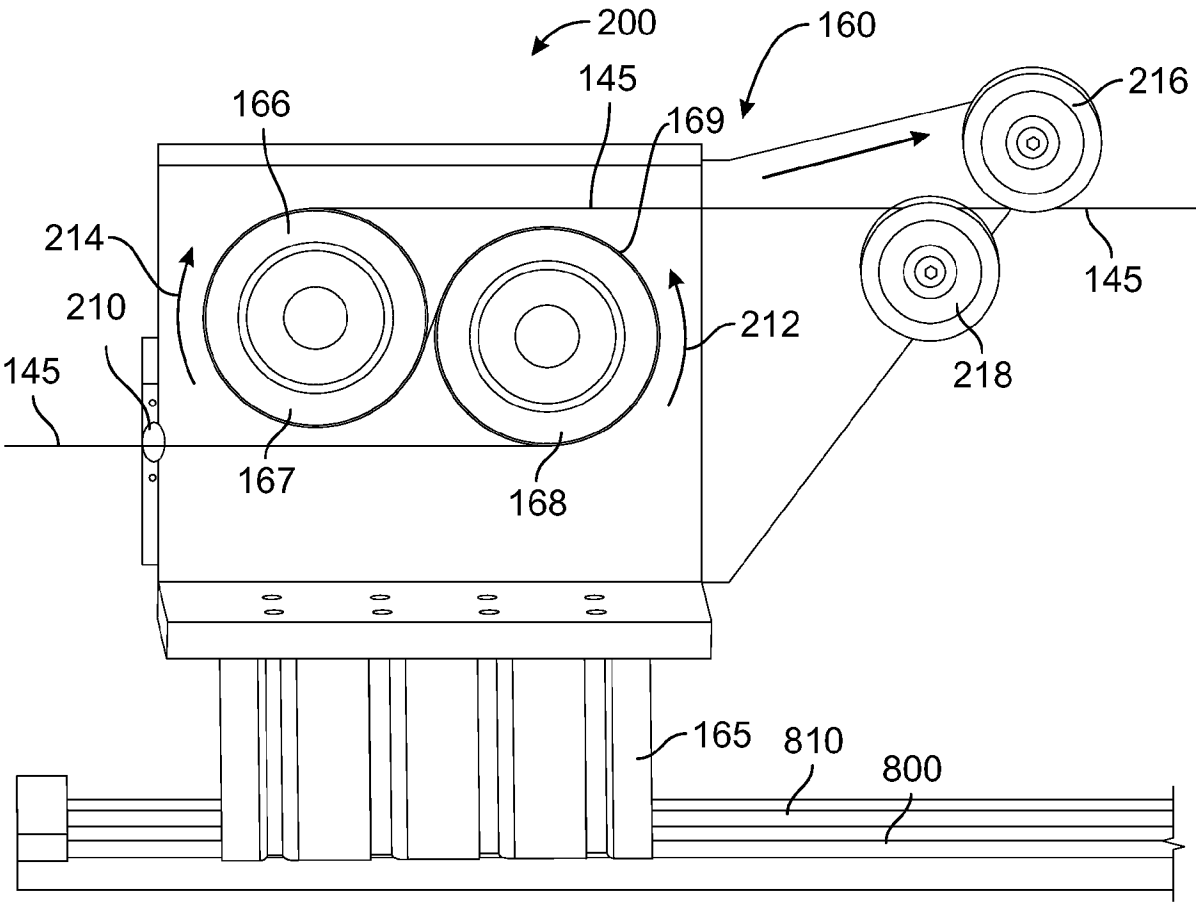
FIG. 7 is diagrammatic representation of a traction system of the feeding section illustrated in FIGS. 5 and 6.

As the conductor wire 145 is drawn off the conductor wire spool 156, this spool 156 freely rotates on the spindle 158. As such, the conductor wire 145 moves into the motorized traction system 160 as the conductor wire 145 is guided between the plurality of traction reels 200 and into the coiling section 300. For example, FIG. 7 illustrates one arrangement for guiding the conductor wire 145 over the plurality of traction reels 200 within the fraction system 160. As illustrated, the conductor wire 145 is first inserted into a guiding eyelet 210 of the motorized traction system 160. Then, the conductor wire 145 bypasses the first traction reel 166 and is fed initially below the second traction reel 168. The conductor wire 145 is then fed in a counter clockwise direction (arrow 212) around an outer surface 169 of the second traction reel 168, back towards the first traction reel 166. Then, at the first traction reel 166, the conductor wire 145 is fed along a bottom portion 167 of the first traction reel 166 in a clock wise direction (arrow 214). The conductor wire is then fed towards the coiling section 300 of the apparatus by way of two traction system output reels 216, 218.

As illustrated, the first output reel 216 and the second output reel 218 support the conductor wire 145 as the conductor wire 145 passes from the plurality of tractions reels 200, into the coiling section 300. The output reels 216, 218 reduce the amount of twisting that may be inflicted on the conductor wire 145. During the fabrication of the susceptor coil assembly 450, although the tension of the susceptor wire 325 may be relatively low, there is a potential to impart a slight twist into the fabricated susceptor coil assembly 450 when, for example, a long section of conductor wire 145 is used. Such a twist may become evident when the susceptor coil assembly 450 is un-spooled from the take-up spool 544 for further processing. As just one example, the susceptor coil assembly 450 may be loaded on to individual spools for integration into calendared silicone. In such a loading scheme, the fabricated susceptor coil assembly 450 may tend to want to twist and can become problematic during handling. The traction system output reels 216, 218 allow the conductor wire 145 to pass through freely in a lateral manner and provide a point of support, close to the winder head 340 of the coiling section 300. This tends to counteract the slight twisting moment on the conductor wire 145 from the winding operation.

Figure 8:
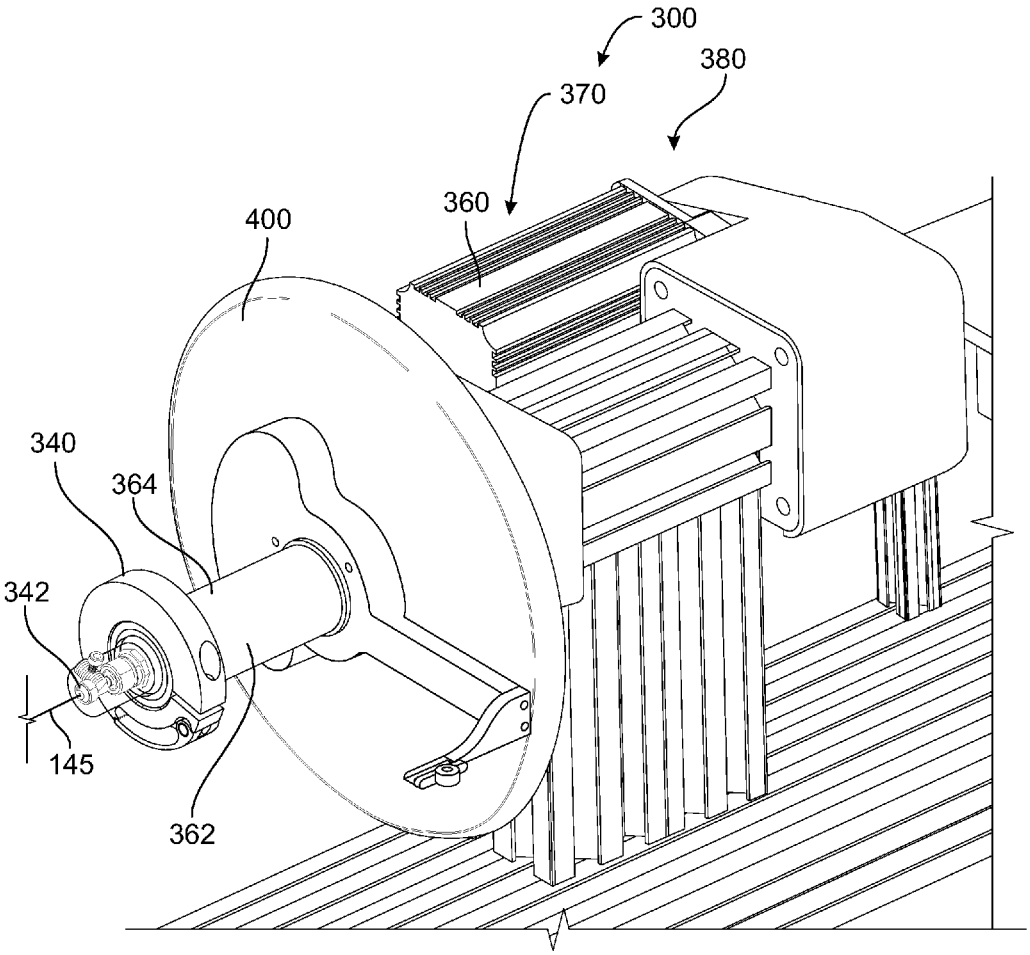
FIG. 8 is a diagrammatic representation of a coiling section of an apparatus for fabricating a susceptor coil assembly according to disclosed embodiments.
Figure 9:
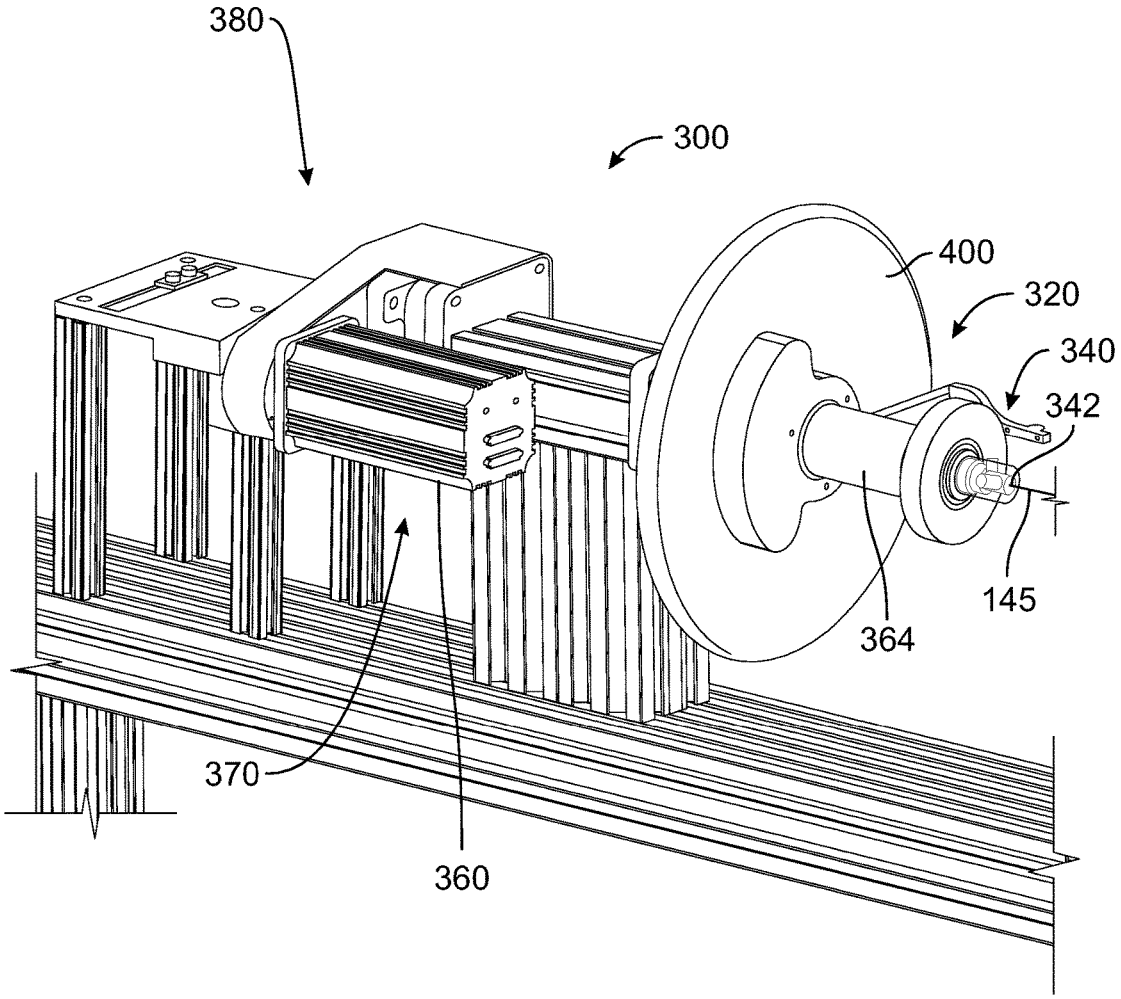
FIG. 9 is another diagrammatic representation of a coiling section of an apparatus for fabricating a susceptor coil assembly according to disclosed embodiments.

From the motorized traction system 160, the conductor wire 145 is then fed into the coiling section 300 of the apparatus 10. FIG. 8 is diagrammatic representation of a coiling system illustrated in FIGS. 3 and 4. FIG. 9 is another diagrammatic representation of a coiling section 300. FIGS. 8 and 9 illustrate the apparatus 10 wherein the conductor wire 145 is being fed into the coiling section 300. Specifically, the conductor wire 145 is fed into a winding head 340 of the coiling section 300. Aside from this winding head 340, the coiling section 300 further comprises a second programmable drive system 380, a spindle motor 360, and a dynamic balancer 400. Within the second programmable drive system 380, operation of a spindle motor 360 may be provided by way of a programmable drive 370 wherein this programmable drive 370 is under the operation and control of the computing device 725 and system software 700 (See, e.g., FIG. 3). In one preferred arrangement, system software 700 coordinates and synchronizes the operation of the first and second programmable drive systems 170, 380 so that the two smart motors (i.e., the spindle motor 360 of the coiling section 300 and the traction system motor 220 of the feeding section 100) are able to turn at a desired ratio relative to one another. Programmable motor synchronization allows the apparatus 10 to maintain a desired tension in the conductor wire 145 while also being able to achieve a desired wrap density in the fabricated susceptor coil assembly 450.

As the conductor wire 145 is fed into the coiling section 300 (i.e., fed into a first wire inlet 342 of the winding head 340), the winding head 340 draws off a susceptor wire 325 from the susceptor wire supply 320 and wraps or coils the susceptor wire 325 along an outer surface 150 of the conductor wire 145 as the conductor wire 145 moves from the feeding section 100, though the coiling section 300, and then into the tensioning section 500.

Figure 2B:
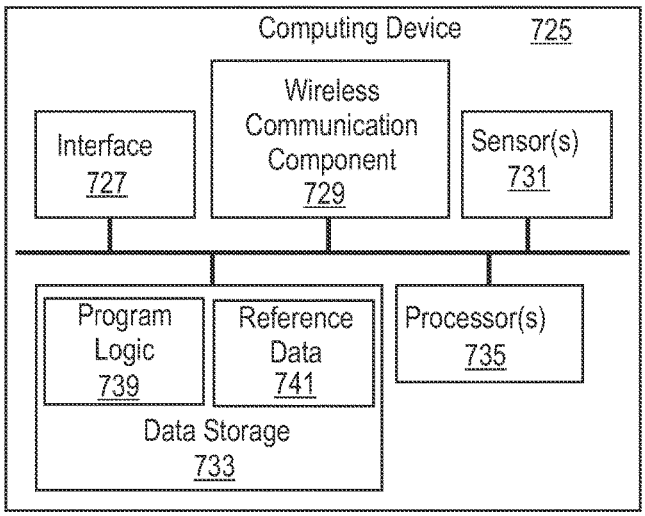
FIG. 2B is a diagrammatic representation of an example computing device, according to one embodiment.
Figure 10:
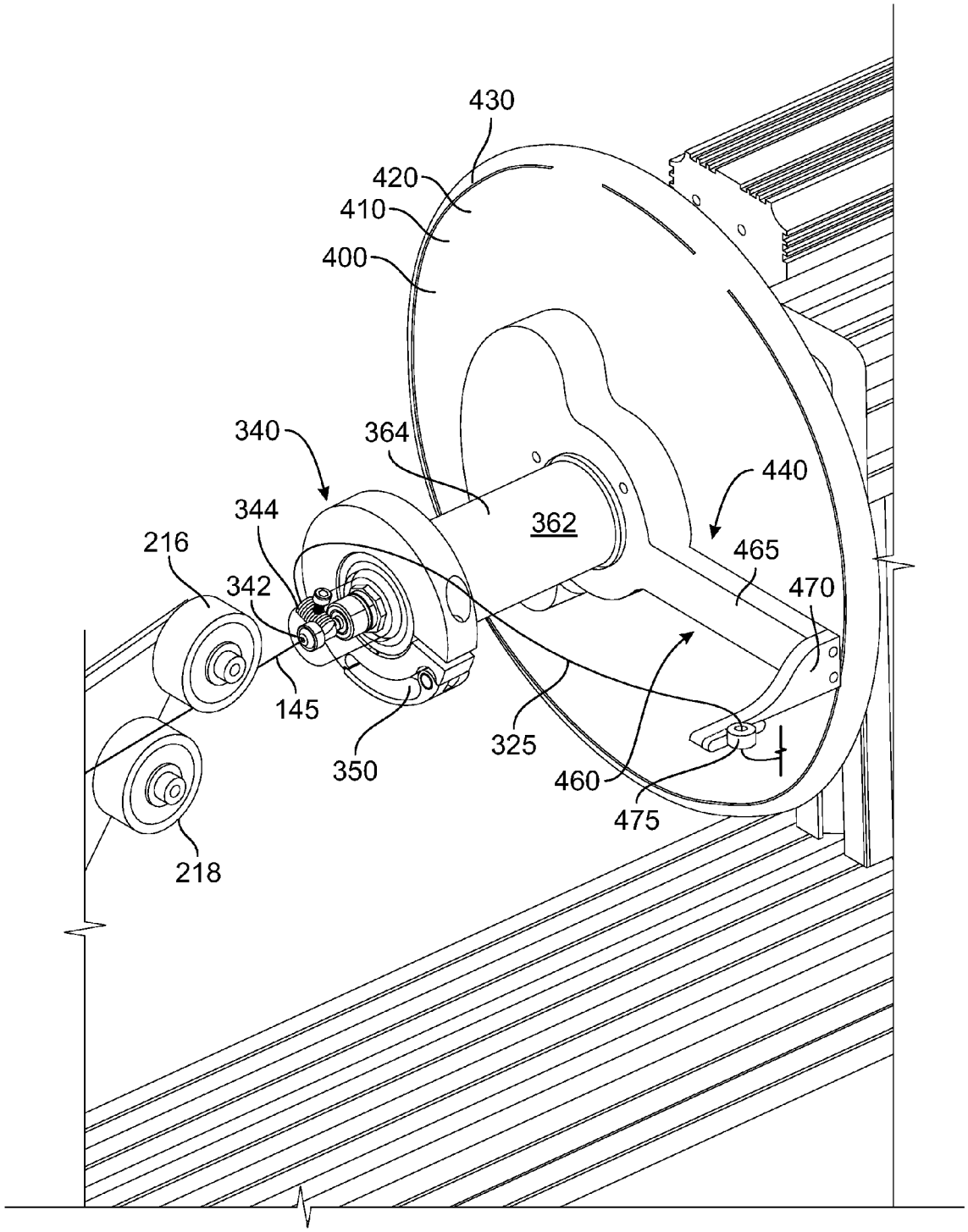
FIG. 10 is a diagrammatic representation of the dynamic balancer of the coiling section illustrated in FIGS. 8 and 9.
Figure 11:
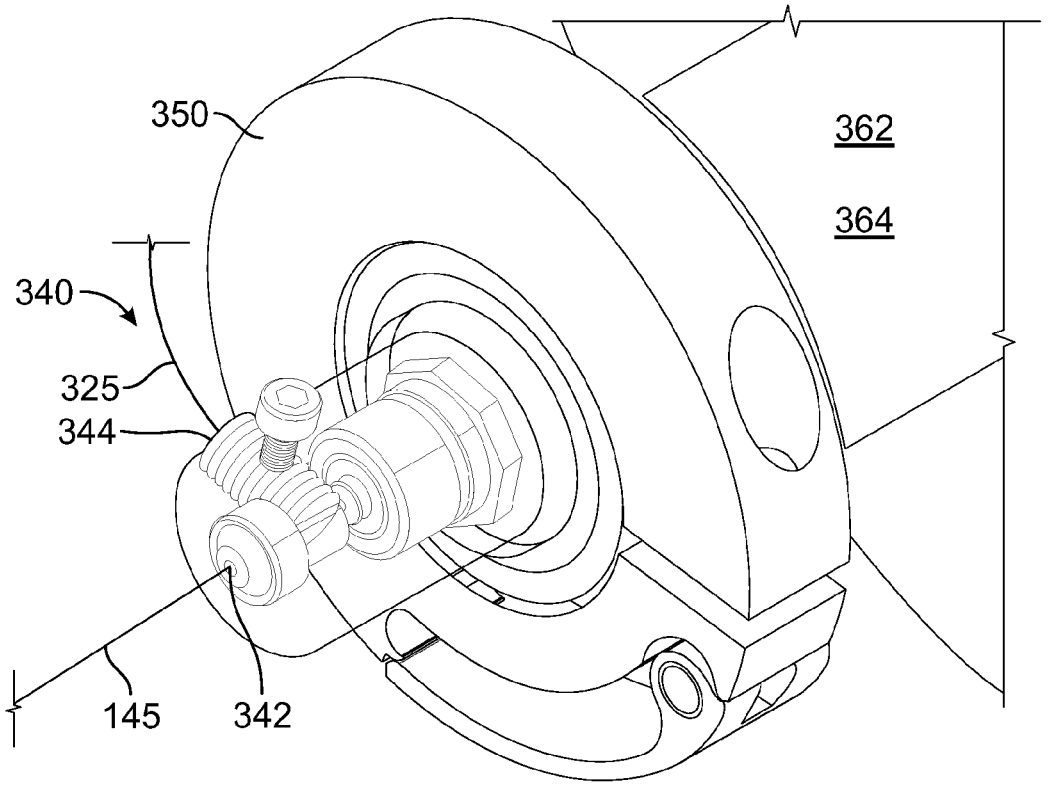
FIG. 11 is a diagrammatic representation of the winder head of the coiling section illustrated in FIGS. 8 and 9.

For example, FIG. 10 illustrates the winding head 340 and the dynamic balancer 400 of the coiling section 300 illustrated in FIGS. 2 and 3. FIG. 11 illustrates a close up view of the winding head 340 illustrated in FIGS. 3 and 4. In this arrangement, a circular locking ring 350 is used to removably affix the winding head 340 to the rotatable spindle 362.

As illustrated in FIGS. 10 and 11, the conductor wire 145 exiting the feeding section 100 enters the first wire inlet 342 of the winding head 340. The winding head 340 is operatively coupled to a rotatable spindle 362 whose rotation is controlled by the spindle motor 360 under the control of the programmable drive 370. A susceptor wire supply 320, in the form of a rotating susceptor wire spool 330 is freely mounted on an axis 364 of this spindle 362 (See, e.g., FIG. 3 illustrating a susceptor wire spool 330 mounted on spindle 362). For example, in one preferred arrangement, the spool 330 of susceptor wire 325 may be attached to the rotating spindle axis 364 through roller bearings and is allowed to spin independently of the rotating spindle 362. Preferably, the spool 330 of susceptor wire 325 spins freely on the rotating spindle 362 and is not directly keyed to the spindle 362. As such, since the spool 330 is allowed to spin freely, in certain applications, the spool 330 will spin slightly faster than the spindle 362 as the susceptor wire 325 is consumed as the susceptor wire 325 is wound along the outer surface 150 of the incoming conductor wire 145. In one preferred arrangement, the tension of the susceptor wire 325 is maintained by a small amount of friction between the rotating spool 330 of susceptor wire 325 and the rotating spindle 362.

Preferably, the dynamic balancer 400 comprises a spherical bi-concave disc 410. The dynamic balancer 400 accommodates an out of balance condition as the susceptor wire 325 is consumed from the rotating susceptor wire supply 320. In one preferred arrangement, the dynamic balancer 400 comprises loose shot 420 in an outer circumferential tube 430 of the dynamic balancer 400 wherein this loose shot 420 automatically migrates to the side of the dynamic balancer 400 that needs more weight to correct an out of balance system condition.

Also illustrated in FIG. 10 is a despooling system 460. In one preferred arrangement, the despooling system 460 guides the susceptor wire 325 off of the susceptor wire supply 320 (e.g., the rotating susceptor wire spool 330 of FIG. 3) and directs the susceptor wire 325 to the winding head 340. Specifically, in this illustrated arrangement, the despooling system 460 is also operatively attached to the rotating spindle 362 and therefore rotates at the same speed as the spindle 362 (and hence the attached winding head 340).

The despooling system 460 comprises a main portion 465 that extends radially away from the spindle 362 and along a surface 440 of the dynamic balancer 400. The despooling system 460 further comprises an arm portion 470 that extends away from the despooling system main portion 465 and vertically away from the dynamic balancer 400, in a direction towards the winding head 340. This arm portion 470 of the despooling system 460 includes an eyelet 475 through which the susceptor wire 325 is guided from the susceptor wire supply 320 and towards the winding head 340 (for ease of explanation, the susceptor wire supply 320 is not illustrated in FIG. 10). During fabrication of the susceptor coil assembly 450, the susceptor wire 325 is taken off the freely rotating susceptor wire spool 330, threaded through the eyelet 475 of the arm portion 470, and then provided to a second wire inlet 344 of the winding head 340. In one arrangement, a guiding tube (not illustrated) may be used for guiding the susceptor wire 325 into the second wire inlet 344. In this manner, rotation of the winding head 340 will wind this susceptor wire 325 around the conductor wire 145 that is being simultaneously fed into the first wire inlet 342 of the winding head 340 from the feed section 100.

FIG. 11 illustrates a close up view of the winding head 340. As illustrated, the winding head 340 is operatively coupled to the rotating spindle 362 and therefore rotates as the same speed as the spindle 362. In this preferred arrangement, the winding head 340 comprises the first wire inlet 342 and the second wire inlet 344. The first wire inlet 342 is configured to receive the linearly moving conductor wire 145 as the conductor wire 145 is fed into the coiling section 300 from the traction system 160 of the feed section 100. The second wire inlet 344 is configured to receive the susceptor wire 325 from the despooling system 460 as the susceptor wire 325 is being drawn off the rotating susceptor wire spool 330. Specifically, the second wire inlet 344 is configured to provide the incoming susceptor wire 325 nearly perpendicular to the incoming conductor wire 145. In this manner, the resulting susceptor coil assembly 450 comprises a conductor wire 145 with the susceptor wire coiled along the outer surface 150 of the conductor wire 145, as illustrated in FIG. 2A thereby comprising a desired susceptor wire density. As such, the susceptor wire density can be varied as a function of the conductor wire 145 linear speed and as well as a function of the rotational speed of the winding head 340.

Figure 12:
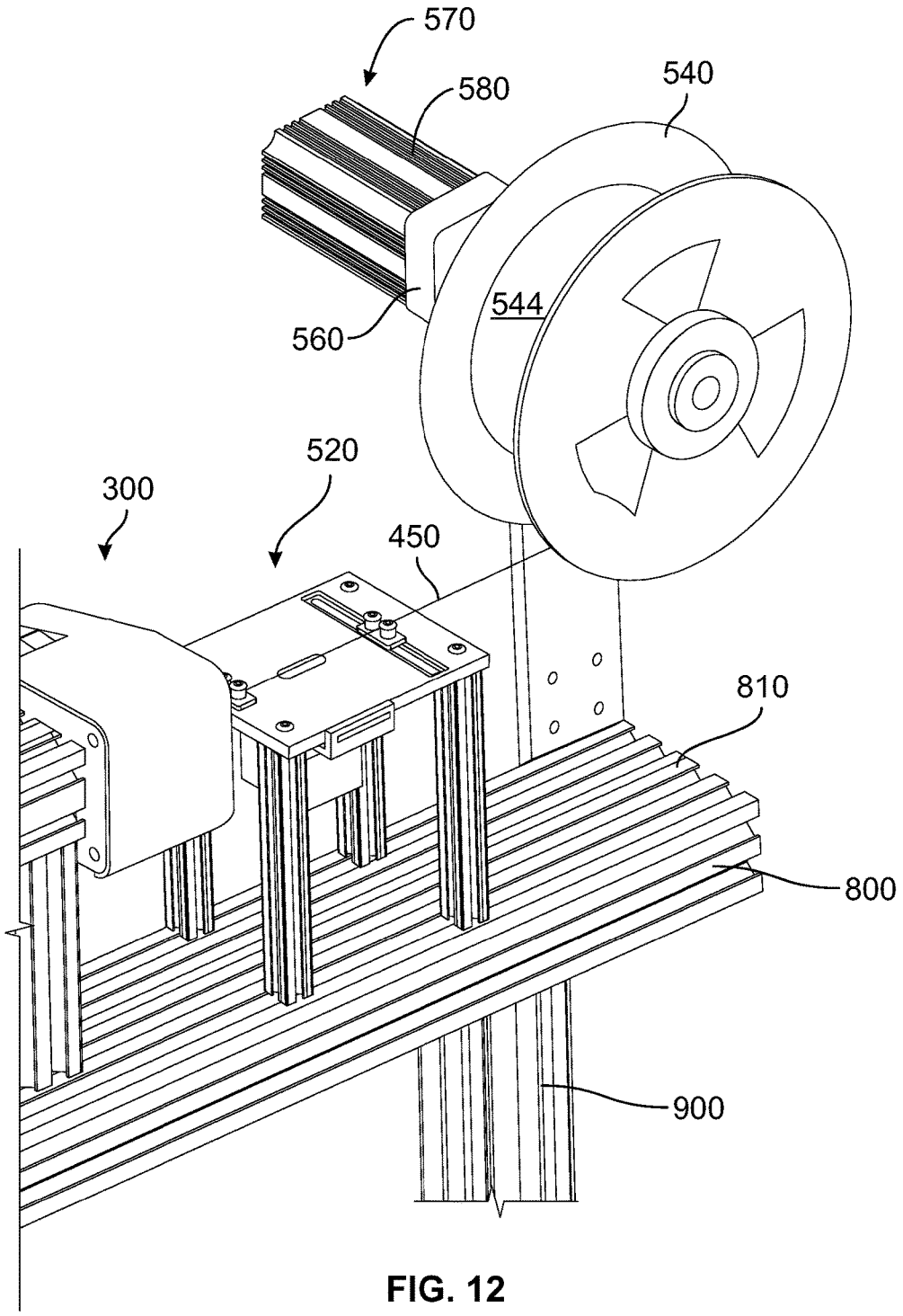
FIG. 12 is a diagrammatic representation of a tensioning section of the apparatus of FIGS. 3 and 4.

Returning to FIGS. 3 and 4, as the fabricated susceptor coil assembly 450 exists out of the coiling section 300, it now enters the tensioning section 500. FIG. 12 is a diagrammatic representation of a tensioning section 500 of the apparatus 10 of FIGS. 3 and 4. The tensioning section 500 comprises a level wind assembly 520, a take up spool 540, and a programmable drive system 570. The programmable drive system 570 comprises a take up motor 560 and a programmable drive 580.

Figure 13A:
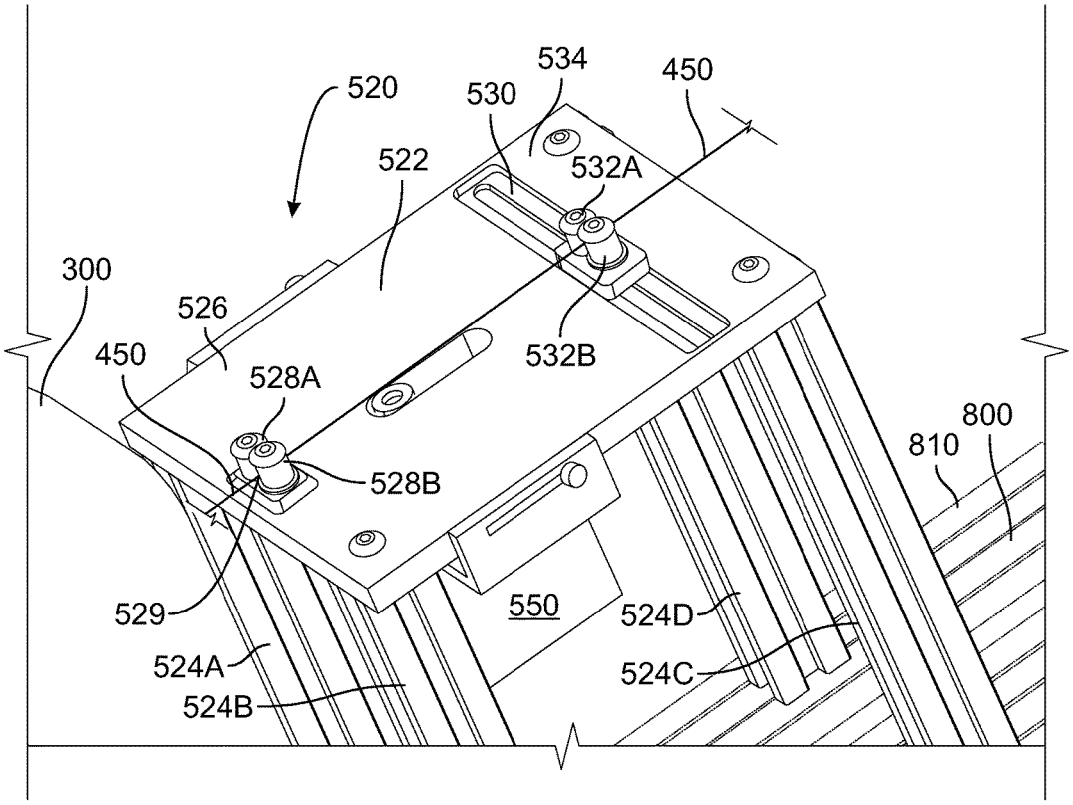
FIG. 13A is a diagrammatic representation of a level winding assembly of the tensioning section illustrated in FIG. 12.
Figure 13B:
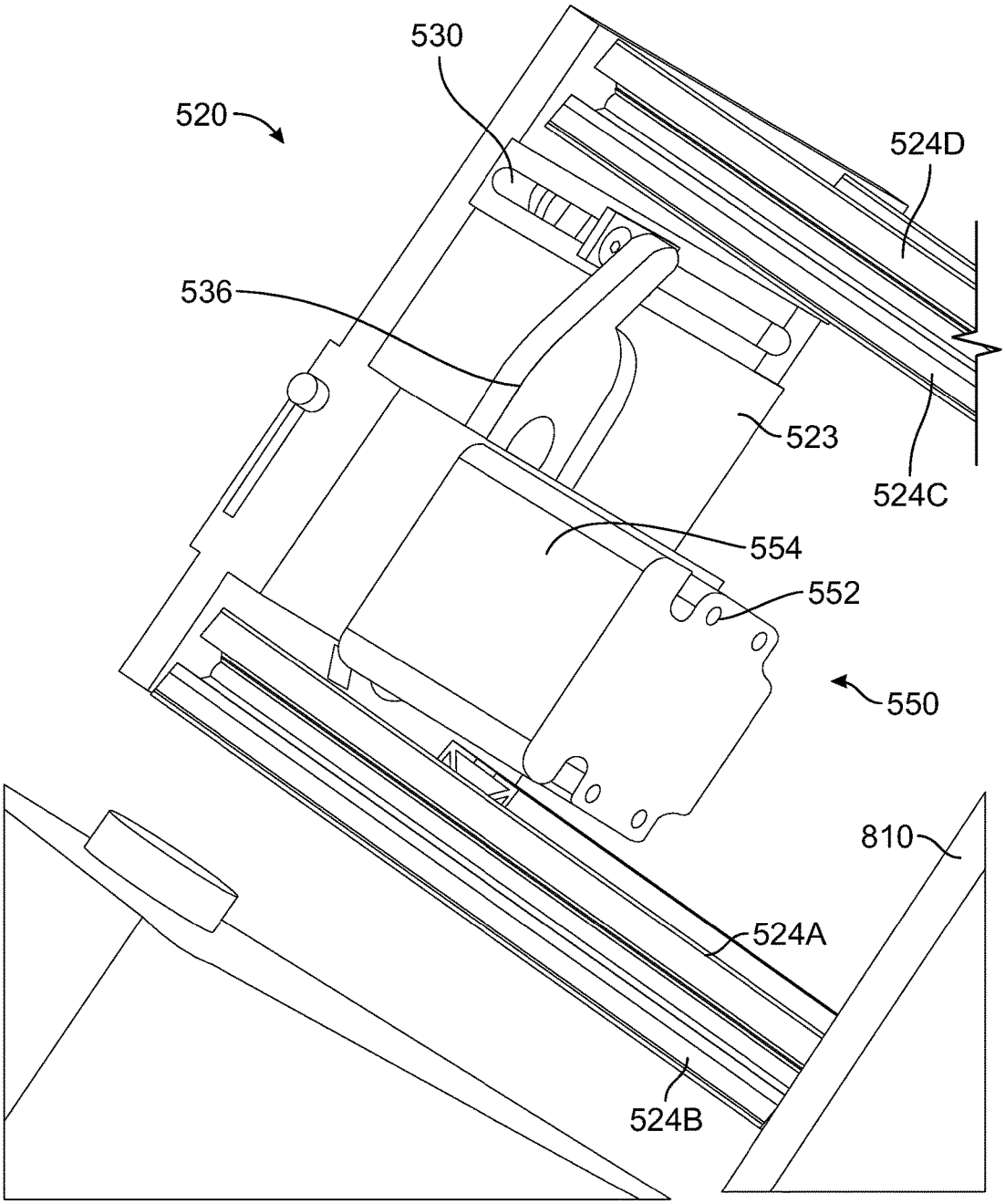
FIG. 13B is another diagrammatic representation of a level winding assembly of the tensioning section illustrated in FIG. 12.

In this illustrated arrangement, the fabricated susceptor coil assembly 450 is pulled out of the coiling section 300 and enters a level wind assembly 520 of the tensioning section 500. For example, FIG. 13A is a diagrammatic representation of a level wind assembly 520 that may be used on accordance with disclosed embodiments. FIG. 13B is another diagrammatic representation of a level wind assembly 520 that may be used on accordance with disclosed embodiments.

Referring now to FIGS. 13A and B, the level wind assembly 520 comprises an upper planar surface 522 and a lower planer surface 523. The lower planer surface 523 of the level wind assembly 520 is supported by a plurality of legs 524 A,B,C,D that are supported along the top surface 810 of the base 800 of the apparatus 10. Near an input section 526 of the level wind assembly 520 two vertically oriented roller pillars 528 A,B are provided. In one preferred arrangement, these roller pillars 528 A,B are stationary. As the susceptor coil assembly 450 exists the coiling section 300, the susceptor coil assembly 450 enters a space 529 residing between these two vertically oriented roller pillars 528 A,B and is pulled along the upper planar surface 522 towards an output section 534 of the level wind assembly 520. Specifically, the susceptor coil assembly 450 is pulled towards the output section 534 of the level wind assembly 520 by way of the third programmable drive system 570 while this drive system 570 maintains a desired tension in the conductor wire 145.

In this illustrated arrangement, the output section 534 of the level wind assembly 520 comprises two vertically oriented moveable roller pillars 532 A,B. These roller pillars 532 A,B are moveable along a track 530 defined by the planar surface 522. Specifically, the movement of the two vertically oriented roller pillars 532 A,B within this track 530 is controlled by a fourth programmable drive system 550. Preferably, this fourth programmable drive system 550 comprises a programmable drive 552 and a level wind assembly motor 554. As can be seen from FIG. 13B, the programmable drive 552 is affixed to the lower planar surface 523 and is controlled and operated by way of the computing device 725 and the system software 700 (See, e.g., FIG. 3). The programmable drive 552 is operatively coupled to a guide plate 536. This guide plate 536 is operatively coupled to the vertically oriented moveable roller pillars 532A,B. The programmable drive 552 operates the motor 554 which oscillates the guide plate 536 (and hence the vertically oriented moveable roller pillars 532A, B) back and forth along the level wind assembly track 530.

As such, during fabrication of the susceptor coil assembly 450, the output roller pillars 532 A,B are moved back and forth along the track 530 such that as the susceptor coil assembly 450 exits the output 534 of the wind assembly 520, the susceptor coil assembly 450 is guided in a controlled manner. For example, the susceptor coil assembly 450 is guided in a controlled manner onto the take up spool 540 of the tensioning section 500 so that the susceptor coil assembly 450 is wound evenly along a width of a hub or core 544 of the take up spool 540.

Figure 14:
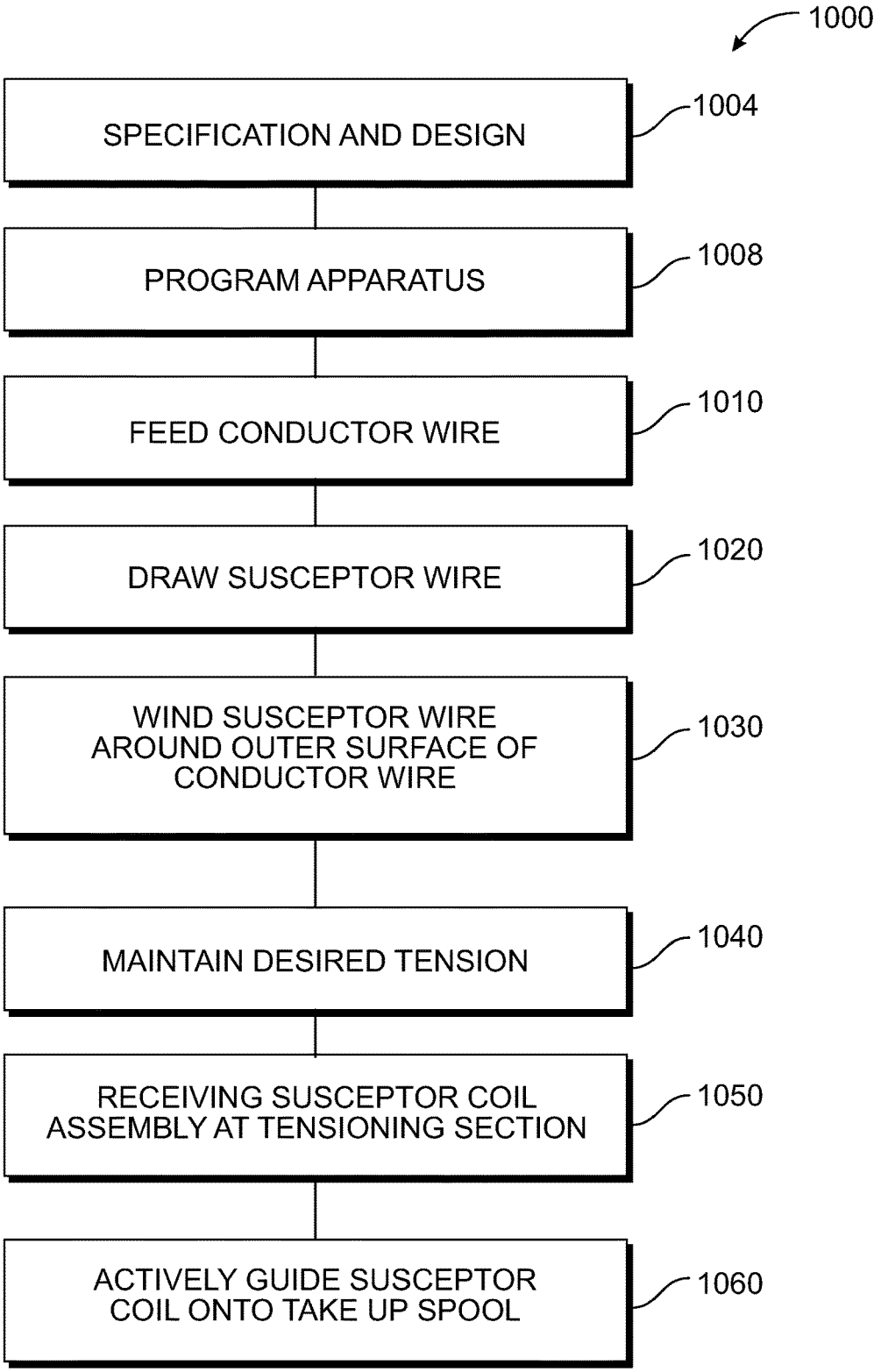
FIG. 14 illustrates steps of a method of fabricating a susceptor coil assembly, such as the susceptor coil assembly disclosed herein.

FIG. 14 illustrates a method 1000 of fabricating a susceptor coil assembly, such as the susceptor coil assembly illustrated in FIG. 2A. According to one arrangement, exemplary method 1000 may include an initial specification and design step 1004. Specifically, this specification and design step may seek to establish a desired heating profile of a heating blanket. As just one example, at this step 1004, this might include the selection of a desired characteristic of the susceptor coil assembly. For example, the material type of susceptor conductor or conductor wire or wires might be selected at this step 1004. In addition, during this step 1004, the various heating profiles and/or heating requirements of a susceptor coil assembly based heating blanket may be determined. In addition, during this step 1004, the number of turns of a susceptor wire over a particular length of a conductor wire may be determined.

Next, at step 1008, an apparatus (such as apparatus 10) may be programmed to fabricate a susceptor coil assembly comprising the desired characteristics determined at step 1004. That is, the apparatus may be programmed (by way of the computing device 725) to utilize a certain type of susceptor, a certain type of conductor wire, to operate at a certain feed rate of the conductor wire, and/or to operate an apparatus winding head at a certain rotational speed. Preferably, the user interface is programmable for programming at least one of the first programmable drive system 170, the second programmable drive system 380, the third programmable drive system 570, and/or the fourth programmable drive system 550 so as to achieve desired a desired characteristic of the susceptor coil assembly 450.

After these operating parameters have been programmed via the computing device 725, the method includes the step 1010 of feeding a conductor wire 145 from a feeding section 100 towards a tensioning section 500. For example, the conductor wire 145 may be fed from a conductor wire supply 140, such as a spool of conductor wire 156. Such a step may be accomplished by utilizing a first programmable drive system 170 to draw the conductor wire 145 over a plurality of traction reels 200 from a conductor wire supply 140 and into the coiling section 300.

Next, at step 1020, the method includes drawing a susceptor wire 325 from a susceptor wire supply 320. Preferably, the susceptor wire supply 320 comprises a freely rotating susceptor wire spool 330. For example, such a step may be accomplished by utilizing a second programmable drive system 380 to achieve a desired feed rate of the susceptor wire 325 from a susceptor wire supply 320 and fed into the coiling section 300.

Next, at step 1030, the method includes the step of winding a susceptor wire 325 around an outer surface 150 of the conductor wire 145 as the conductor wire 145 moves from the feeding section 100 towards a tensioning section 500 so as to fabricate a susceptor coil assembly 450. Winding the susceptor wire 325 around the outer surface 150 of the conductor wire 145 takes place in a coiling section 300. For example, a winding head 340 as herein described may be utilized at step 1030 for winding the susceptor wire 325 from the susceptor wire supply 320 along an outer surface 150 of the conductor wire 145 so as to fabricate the susceptor coil assembly 450 as described herein.

At step 1040, the method includes the step of maintaining a desired tension in the conductor wire 145 as the conductor wire 145 is fed from the feeding section 100 towards the tensioning section 500.

At step 1050, the method includes the step of receiving the susceptor coil assembly 450 by a tensioning section 500 from the winding section 300. For example, a level wind assembly 520 of the tensioning section 500 may receive the susceptor coil assembly 450. At optional step 1060, the level wind assembly 520 actively guides the susceptor coil assembly 450 from the level wind assembly 520 onto a core 544 of a take up spool 540 in the tensioning section 500.

Figure 15:
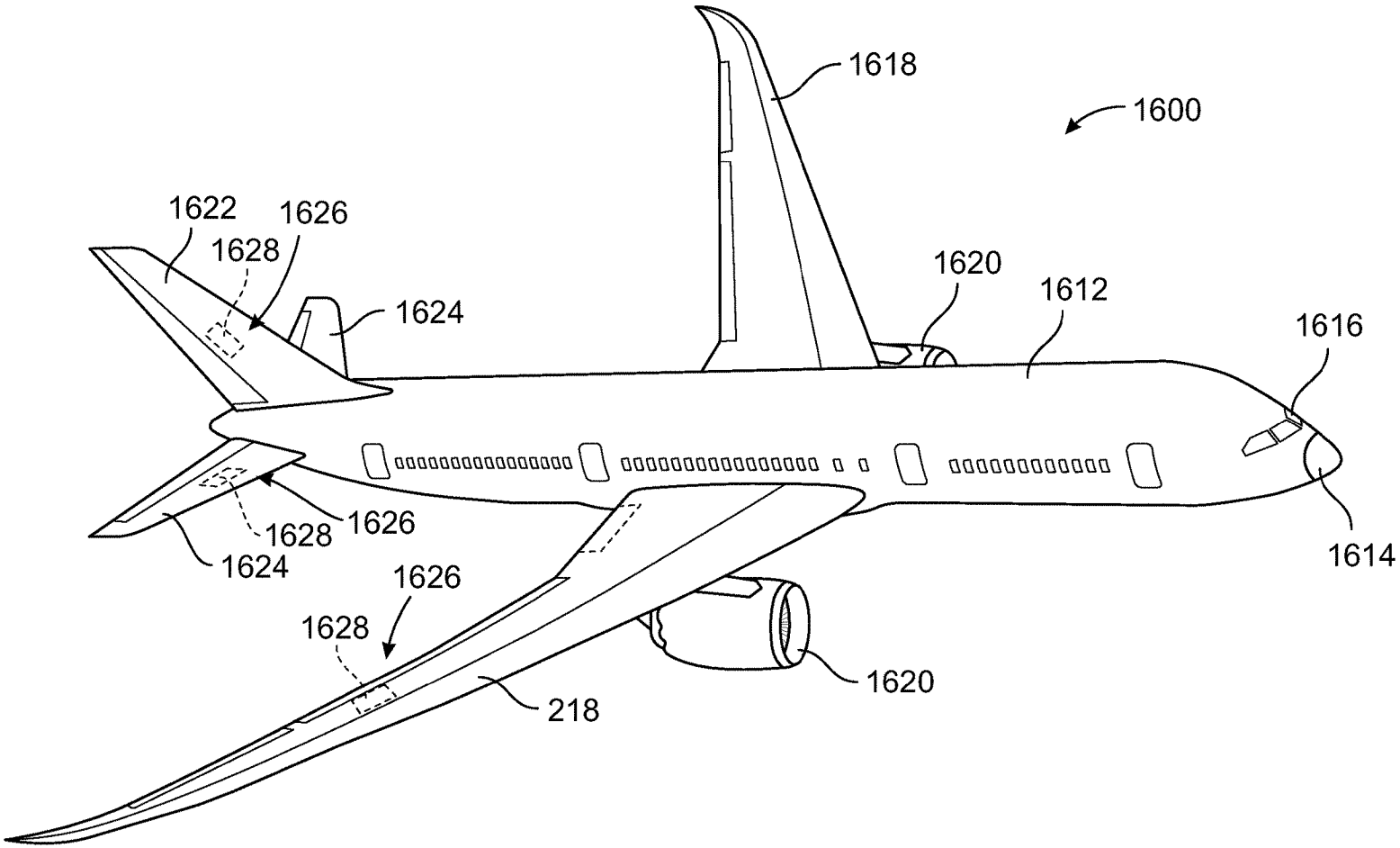
FIG. 15 is a diagrammatic representation of a perspective view of an aircraft that may incorporate one or more composite laminate structures manufactured in accordance with one or more embodiments disclosed herein.

FIG. 15 is an illustration of a perspective view of an aircraft 1600 that may incorporate one or more composite laminate structures heated by a heating blanket incorporating one of the susceptor coil assembly embodiments of the present disclosure.

As shown in FIG. 15, the aircraft 1600 comprises a fuselage 1612, a nose 1614, a cockpit 1616, wings 1618 operatively coupled to the fuselage 1620, one or more propulsion units 1620, a tail vertical stabilizer 1622, and one or more tail horizontal stabilizers 1624. Although the aircraft 1600 shown in FIG. 15 is generally representative of a commercial passenger aircraft, heating blankets comprising one or more susceptor coil assemblies as disclosed herein, may also be employed in other types of aircraft or air vehicles. More specifically, the teachings of the disclosed embodiments may be applied to other passenger aircraft, cargo aircraft, military aircraft, rotorcraft, and other types of aircraft or aerial vehicles, as well as aerospace vehicles, satellites, space launch vehicles, rockets, and other aerospace vehicles. It may also be appreciated that embodiments of structures and methods in accordance with the disclosure may be utilized in other transport vehicles, such as boats and other watercraft, trains, automobiles, trucks, buses, or other suitable transport vehicles heated by susceptor coil assembly based heating blankets as disclosed herein.

Figure 16:
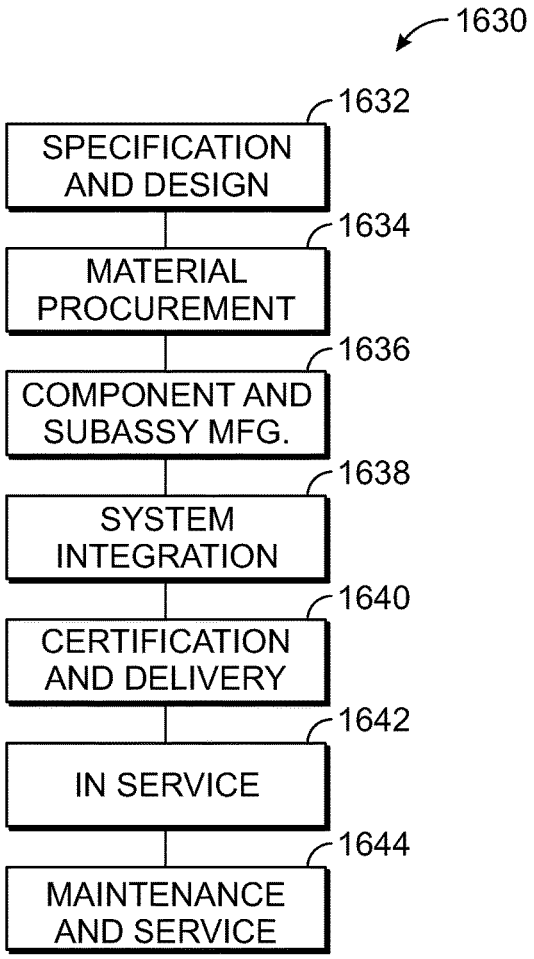
FIG. 16 is a diagrammatic representation of a flow diagram of aircraft production and service methodology.

Embodiments of the disclosure may find use in a variety of potential applications, particularly in the transportation industry, including for example, aerospace, marine, automotive applications and other application where thermoplastic composite tubular structures may be used. Therefore, referring now to FIGS. 16 and 17, embodiments of the disclosure may be used in the context of an aircraft manufacturing and service method 1630 as shown in FIG. 16 and an aircraft 1650 as shown in FIG. 15. Aircraft applications of the disclosed embodiments may include, for example, without limitation, the design and fabrication of composite laminates fabricated by way of a releasable support as disclosed herein.

During pre-production, exemplary method 1630 may include specification and design 1632 of the aircraft 1650 and material procurement 1634. As just one example, at this step, this might include the selection of material type of susceptor conductor or conductors may be determined at this step. In addition, during this step, the various heating requirements and/or heating profiles of a susceptor coil assembly based heating blanket may be determined. For example, during this step, the number of turns of a susceptor wire over a particular length of a conductor wire may be determined.

During production, component and subassembly manufacturing 1636 and system integration 1638 of the aircraft 1650 takes place. After such a component and subassembly manufacturing step, the aircraft 1650 may go through certification and delivery 1640 in order to be placed in service 1642. While in service by a customer, the aircraft 1650 is scheduled for routine maintenance and service 1644, which may also include modification, reconfiguration, refurbishment, and so on.

Each of the process steps of method 1650 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

Figure 17:
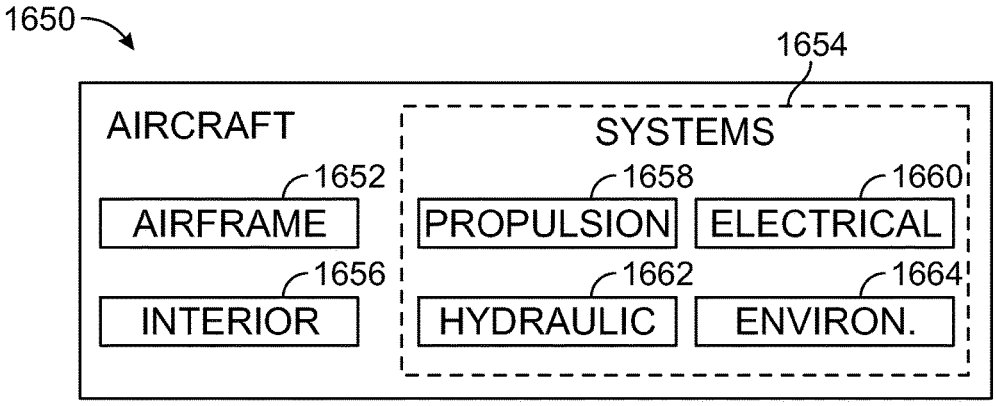
FIG. 17 is a diagrammatic representation of a block diagram of an aircraft.

As shown in FIG. 17, the aircraft 1650 produced by exemplary method 1630 may include an airframe 1652 with a plurality of high-level systems 1654 and an interior 1656. Examples of high-level systems 1654 may include one or more of a propulsion system 1658, an electrical system 1660, a hydraulic system 1662, and an environmental system 1664. Any number of other systems may be included. Although an aerospace example is shown, the principles of the disclosure may be applied to other industries, such as the marine and automotive industries.

Systems and methods embodied herein may be employed during any one or more of the stages of the production and service method 1630. For example, components or subassemblies corresponding to production process may be fabricated or manufactured in a manner similar to components or subassemblies produced while the aircraft 1650 is in service. Also, one or more apparatus embodiments, method embodiments, or a combination thereof may be utilized during the production stages 1632 and 1634, for example, by substantially expediting assembly of or reducing the cost of an aircraft 1650. Similarly, one or more of apparatus embodiments, method embodiments, or a combination thereof may be utilized while the aircraft 1650 is in service, for example and without limitation, to maintenance and service 1644.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

We claim:

1. An apparatus for fabricating a susceptor coil assembly, the apparatus comprising:

a tensioning section;

a feeding section configured for feeding a conductor wire toward the tensioning section, the tensioning section being configured for maintaining a desired tension of the conductor wire; and a coiling section configured for winding a susceptor wire around an outer surface of the conductor wire so as to fabricate a susceptor coil assembly as the conductor wire moves from the feeding section toward the tensioning section, the coiling section comprising a winder head comprising:

a first wire inlet configured for receiving the conductor wire from the feeding section; and a second wire inlet that extends radially from the first wire inlet and is configured for radially receiving the susceptor wire as the coiling section winds the susceptor wire and for receiving the conductor wire as the conductor wire moves toward the tensioning section.

2. The apparatus of claim 1 further comprising a programmable drive that is programmable to achieve a desired feedrate of the conductor wire from the feeding section to the coiling section.

3. The apparatus of claim 2 wherein the programmable drive operates a plurality of traction reels, and a first traction system motor operating the plurality of traction reels, such that the conductor wire is drawn over the plurality of traction reels from a conductor wire supply and into the coiling section.

4. The apparatus of claim 3 further comprising a first output reel and a second output reel, wherein both the first output reel and the second output reel support the conductor wire as the conductor wire passes from the plurality of traction reels and into the coiling section.

5. The apparatus of claim 1 further comprising a programmable drive that is programmable to achieve a desired feedrate of the susceptor wire from a susceptor wire supply and into the coiling section.

6. The apparatus of claim 1 further comprising:

a programmable drive that is programmable to achieve a desired tension in the conductor wire as the conductor wire is fed from the feeding section towards the tensioning section.

7. The apparatus of claim 1 further comprising:

a level wind assembly, the level wind assembly being configured to receive the susceptor coil assembly from the coiling section and guide the susceptor coil assembly into the tensioning section.

8. The apparatus of claim 7 wherein:

the level wind assembly is configured to guide the susceptor coil assembly into the tensioning section by guiding the susceptor coil assembly in a predetermined manner onto a core of a take up spool of the tensioning section.

9. The apparatus of claim 2 further comprising:

a user interface configured for programming an operating parameter of the programmable drive.

10. The apparatus of claim 9 wherein the user interface is programmable for programming the programmable drive so as to achieve a desired characteristic of the susceptor coil assembly.

11. The apparatus of claim 10 wherein the desired characteristic of the susceptor coil assembly comprises a susceptor coil assembly wrap density, and wherein the susceptor coil assembly wrap density comprises a predetermined number of susceptor wire wraps per length of the conductor wire.

12. A method for fabricating a susceptor coil assembly, the method comprising:

feeding an electrically conductive wire from a feeding section toward a tensioning section;

winding a susceptor wire around an outer surface of the electrically conductive wire as the electrically conductive wire moves from the feeding section toward the tensioning section so as to fabricate a susceptor coil assembly; and utilizing the tensioning section to maintain a desired tension in the electrically conductive wire.

13. The method of claim 12 further comprising:

utilizing a programmable drive to draw the electrically conductive wire over a plurality of reels from an electrically conductive wire supply and into a coiling section, the coiling section being downstream of the feeding section.

14. The method of claim 12 further comprising utilizing a programmable drive to achieve a desired feedrate of the susceptor wire from a susceptor wire supply into a coiling section, the coiling section being downstream of the feeding section.

15. The method of claim 12 further comprising:

maintaining a desired tension in the electrically conductive wire as the electrically conductive wire is fed from the feeding section toward the tensioning section.

16. The method of claim 12 further comprising:

receiving the susceptor coil assembly by a level wind assembly from a coiling section, the coiling section being downstream of the feeding section.

17. The method of claim 16 further comprising:

guiding the susceptor coil assembly from the level wind assembly onto a core of a take up spool in the tensioning section.

18. The method of claim 12 further comprising:

winding the susceptor wire generally perpendicular along an outer surface of the electrically conductive wire so as to fabricate the susceptor coil assembly.

19. The method of claim 12 further comprising:

utilizing a programmable drive to achieve a desired characteristic of the susceptor coil assembly.

20. The apparatus of claim 5 further comprising:

a user interface configured for programming an operating parameter of the programmable drive.

* * * * *